United States Patent [19]

Koster

[11] Patent Number: 4,865,127

[45] Date of Patent: Sep. 12, 1989

[54] METHOD AND APPARATUS FOR REPAIRING CASINGS AND THE LIKE

[75] Inventor: Charles H. Koster, Alvin, Tex.

[73] Assignee: Nu-Bore Systems, Alvin, Tex.

[21] Appl. No.: 223,557

[22] Filed: Jul. 25, 1988

Related U.S. Application Data

[63] Continuation-in-part of Ser. No. 144,516, Jan. 15, 1988.

[51] Int. Cl.[4] ..... E21B 33/127

[52] U.S. Cl. ..... 166/277; 166/387; 166/187

[58] Field of Search ..... 166/277, 380, 387, 187, 166/191, 242, 63; 138/150, 154; 493/300

[56] References Cited

U.S. PATENT DOCUMENTS

| | | | |
|---|---|---|---|
| 3,364,993 | 1/1968 | Skipper | 166/207 X |
| 4,246,964 | 1/1981 | Brandell | 166/191 X |
| 4,566,535 | 1/1986 | Sanford | 166/191 X |
| 4,589,484 | 5/1986 | Doherty et al. | 166/179 |

*Primary Examiner*—William P. Neuder

*Attorney, Agent, or Firm*—Ewan C. MacQueen

[57] ABSTRACT

The invention relates to a method and apparatus for relining bores such as oil wells, using multiple layers of spiral wrapped, resilient lining material which expands to form a continuous liner for the bore.

17 Claims, 8 Drawing Sheets

METHOD AND APPARATUS FOR REPAIRING CASINGS AND THE LIKE

The present application is a continuation-in-part of my previous application Ser. No. 144,516, filed Jan. 15, 1988.

BACKGROUND OF THE INVENTION

Underground bores such as oil wells, pipelines, gas mains and the like are susceptible to cracking or rupturing due to corrosion of the existing casings, shifts in the ground and external pressures which can crush or rupture the bores. These losses of integrity can cause the fluids passing through them to seep into the environment which can cause contamination to water tables as well as presenting fire hazards in the cases of gas mains and the like.

Likewise, certain situations require the closure of previous perforations or other man-made openings in casings, tubings or the like. In some cases repairs are required to bores that have been damaged by wear or abrasion by moving components. Also, the relining of a bore to present a different material interface within the bore can be extremely advantageous.

To repair these bores various elaborate methods have been developed which generally involve inserting a new section of pipe or liner into the bore to be repaired and placing the new lining in the appropriate section and then expanding the lining so that it then fills or covers the gap. These methods for repairing the casings generally have been limited to fairly small areas because of the difficulties encountered in handling long liners, and have largely been unsuccessful due to the problem of "springback" of metallic tubular materials when expanded internally. Springback prevents establishment of a good seal against the well casing.

SUMMARY OF THE INVENTION

The method for relining downhole casings and the like which is provided for by this invention involves spiral wrapping of a resilient flexible strip lining material about a special downhole tool to the length of the patch or repair to be made. The tool with wrapping attached is inserted into a bore of slightly larger internal diameter than the overall diameter of the wrapped tool to the location of the patch or repair to be made. One end of the wrapping material is then expanded from the tool tightly against the internal wall of the bore to be relined and the wrapping is then unwound progressively off the tool until, by its resiliency, it tightly engages the walls of the bore to be lined to the full length of the wrapping. The other end of the wrapping material is then expanded from the tool and against the bore wall.

It is desirable for one of the alternating layers of material to be comprised of a settable resinous material such as an epoxy to ensure adhesion and a complete seal between the various layers of lining materials.

Once the lining material is in place, the mandrel is then withdrawn and the bore is returned to use.

By the term "bore" it is meant any cylindrical opening or the like within a surface to include oil wells, water mains, gas mains, pipelines, electrical conduits or the like.

By "lining material" it is meant any form of flexible material having sufficient resiliency or elasticity to uncoil in the manner described. This material can be various sheet metal such as steel having a thickness of between 0.004 inches and 0.030 inches with a preferable thickness of 0.010 inches or dictated by the bore to be repaired. For example, for oil wells the use of beryllium copper is preferred because of its corrosion resistance and high strength. In other cases, various plastics reinforced with glass fiber or carbon fiber, etc. may be employed. Special stainless steels and nickel-base alloys may be of use. It is to be borne in mind that the interior of an oil well is a hostile environment containing chlorides, hydrocarbons, sometimes sulfides, etc. Many metallic materials simply disintegrate in such an environment. Beryllium copper, such as Alloy 190, having a yield strength of about 100,000 to about 125,000 psi and a modulus of $18.5 \times 10^6$ is particularly well suited to the service.

DETAILED DESCRIPTION OF THE INVENTION

In carrying the invention into practice, the downhole tool is first prepared. The tool comprises an upper packer assembly, a lower packer assembly, which incorporates a release device such as a shear pin operable from the surface to permit rotation of the upper packer with respect to the lower packer upon demand, with the two packer assemblies being spaced apart by a mandrel section of desired length having in mind the length of patch to be effected in the well to be repaired. The mandrel section itself may be made of sections of hollow steel such as tubing steel screwed together to form the requisite length. Each of the packer assemblies has a hollow core, with a check valve being provided at the lower end of the lower packer assembly. The downhole tool is suspended in the well on hollow tubing string steel, permitting transmission of hydraulic commands to the tool from the surface.

Figure 2:
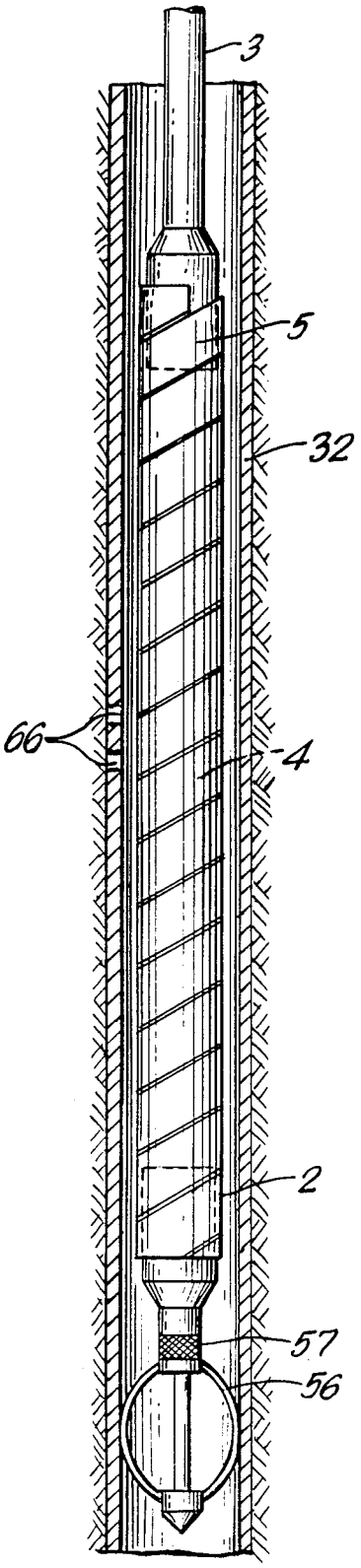
FIG. 2 shows the tool when it is first placed into the bore.

The completed downhole tool with spirally wrapped strip material therearound is depicted in FIG. 2 of the drawing as being suspended in a well adjacent a failed place in the well casing to be patched. As shown in FIG. 2, the tool comprises a mandrel 4 having a lower packer assembly 2 and an upper packer assembly 5. Lining material 21 is shown wrapped about the mandrel in FIG. 2. A centralizer 56 may be employed at the bottom end of the tool. The tool is shown suspended from tubing string 3. Other essential features of the downhole tool include circulating means for fluids which are controlled by commands from the surface. These will be described in connection with FIGS. 4 through 7.

Figure 1:
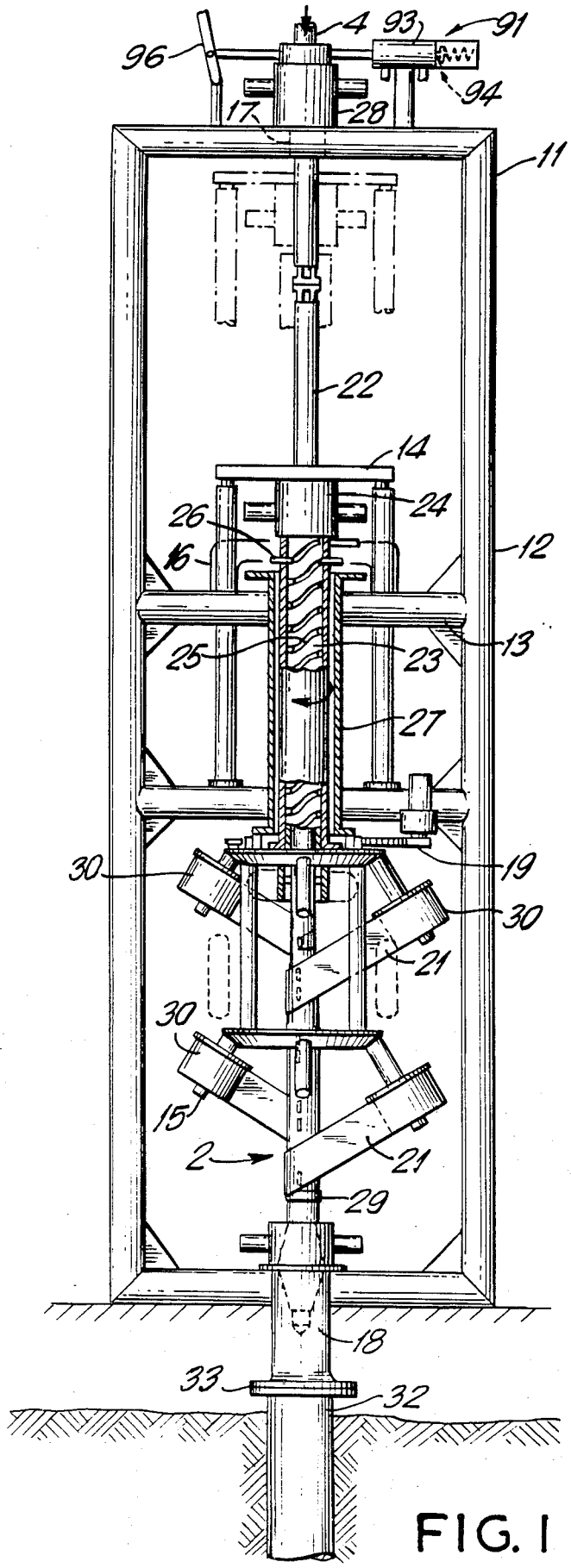
FIG. 1 shows a machine for wrapping lining material about the downhole tool at the well head.

Turning now to FIG. 1, which depicts a machine 11 mounted on the well head of a well to be patched in accordance with the invention, it will be seen that the machine consists of a frame 12 bearing a fixed crosshead 13 and a movable crosshead 14. The movable crosshead is raised and lowered by lead screw 23 which is powered by reversible power head 16 through pins 26. Upper and lower collets, designated 28 and 24 respectively, are mounted on the frame about upper port 17 and on movable crosshead 14. Collets 24 and 28 are preferably of the type which are normally closed and require actuation to be opened. Material payoff assembly 27 is preferably mounted concentrically about lead screw 23 and is powered by the same power head 16 which powers lead screw 23. Material payoff means 27 bears a plurality of axles 15 adapted to hold spools of strip 30. Brake means 19 prevents rotation of material payoff means 27 when the movable crosshead 14 is being raised. For this purpose also, drive means 16 is connected to material payoff means 27 by ratchet means so that material payoff means 27 is powered only when lead screw 23 is descending. Upper and lower ports 17 and 18 in the frame are aligned so that tool 22 can be passed completely therethrough. The collets 24 and 28 are controlled such that at least one of them is always closed to grip the tool while the wrapping operation is in progress.

Figure 10:
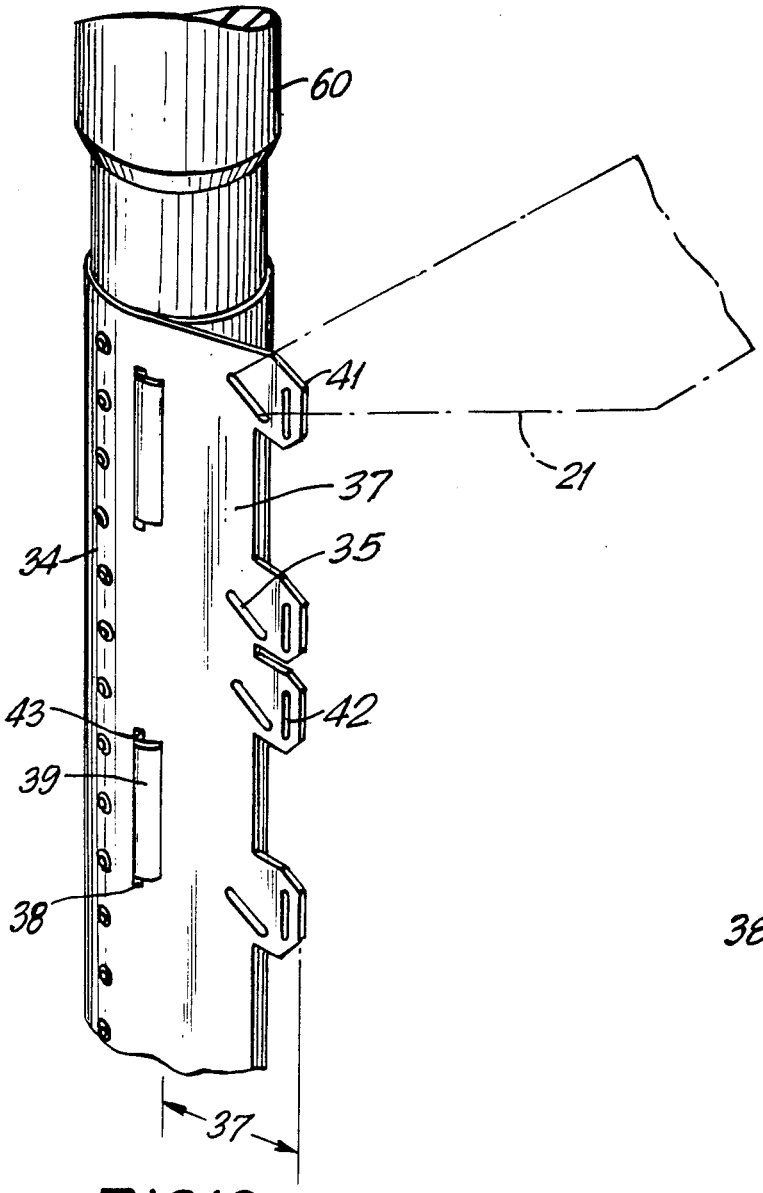
FIGS. 10 and 11 depict the sheet of FIG. 9 after it has been wrapped into a collar.

To initiate the wrapping operation, tool 22 is passed downwardly through machine 11 to the point at which the lower packer assembly 2 reaches the wrapping area, i.e., the area at which the strip material 21 wound on spools 30 can reach tool 22 at the angle preset by the axles 15 on which spools 30 are mounted. The strip material is fastened to tool 22 over the lower packer assembly 2, preferably in the pattern depicted in FIG. 8 and preferably using the collar device 34 shown on FIG. 10 to fasten the strip material to tool 22. At this point, the movable crosshead 14 is in the fully raised position with collet 28 closed. Collet 24 is then closed and collet 28 is opened. Power head 16 then moves tool 22 downward while wrapping strip material 21 thereabout. Movement of the tool downward and the rate of rotation of the material payoff assembly 27 are fixed and coordinated by the pitch of lead screw 23. When the movable crosshead 14 reaches the lower end of its travel, collet 24 is closed, upper collet 28 is opened and brake 19 is set so that the wrapped-on strip material 21 will not become unwrapped during the elevation of crosshead 14. Crosshead 14 is then elevated by reversing power head 16, while no power is transmitted to material payoff means 27 due to the fact that the drive thereto is ratcheted. The process of alternately raising and lowering crosshead 14 to feed and wrap portions of tool 22 is continued until the upper packer assembly 5 is reached and wrapped. A collar similar to that shown in FIG. 10 is then wrapped about the upper packer assembly 5 to lock the wrapped strip thereto. The strip material is then cut off and the tool 22 is ready for use. Since there is no longer any need for the machine to remain at the wellhead, and in fact, it can be transported to the next job, tool 22 can be lowered completely through the wrapping area, fitted with a split collar as a stop on the wellhead to permit removal of the machine, and the process of patching the well can proceed.

Before proceeding with a discussion of the well patching procedure, the construction of the upper and lower packer assemblies will be described with reference to FIGS. 4 and 5 (Lower) and FIGS. 6 and 7 (Upper) packer assemblies, respectively. These Figures illustrate that the essential features of the respective packer assemblies are: (1) Expandable means (the packers) at the upper and lower ends of the tool permitting expansion from the tool diameter to fit forcibly against the well casing, (2) Spindle means preferably located adjacent the lower packer assembly which on command can permit rotation of the mandrel and upper packer assembly with respect to the lower packer assembly, and (3) Valve means permitting controlled circulation of fluid under pressure along the inside face of the newly formed well liner.

Figure 4:
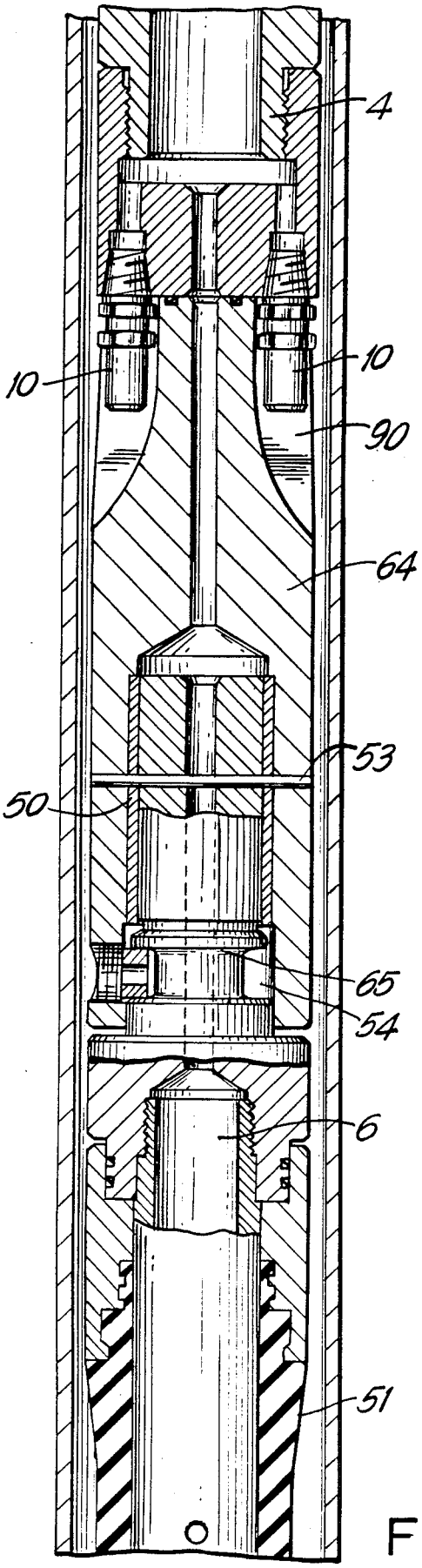
FIGS. 4 and 5 show, in cross section, the lower packer assembly.
Figure 5:
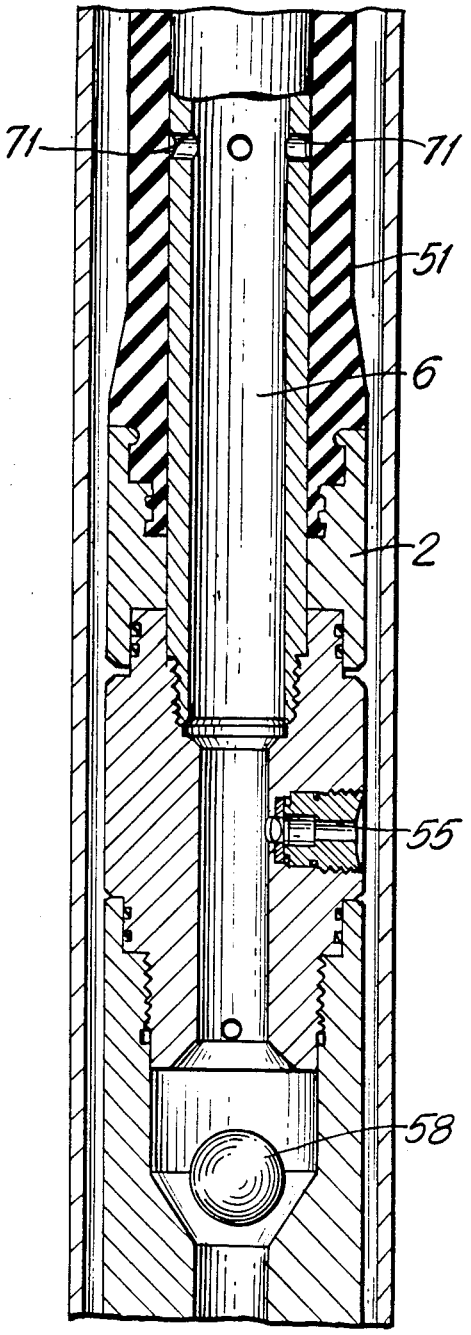

FIGS. 4 and 5 illustrate the upper and lower portions of the lower packer assembly, with reference character 64 representing the steel body of the assembly, 51 representing the packer itself, and being an inflatable rubber sleeve fastened at the ends to the assembly body 64, reference character 50 representing the spindle held together from rotation by shear pin 53, rollers 54 which rotate in race 65 after the shear pin is broken and the upper portion of the tool is rotated from the surface, valves 10 are circulating valves operated by interior tool hydraulic pressure in the hollow core 6, holes 71 communicate between the tool core 6 to the inner face of the packer 51 to inflate packer 51 in response to hydraulic pressure PI in core 6, check valve 58 of the ball-check type admits fluid contents of the well to the interior of the tool as the tool is lowered into the well so that interior pressure in the tool is equalized to the exterior pressure, screen 72 prevents entry of well solids into the interior of the tool, and 55 represents pressure discs to be blown after the well patch is completed and the upper and lower packers are to be deflated for withdrawal of the tool from the well. It will be appreciated that additional ball-check valves may be employed in patching wells which have excessive amounts of suspended solid material and that the area of the screen can be varied depending upon the conditions encountered in the well.

Figure 6:
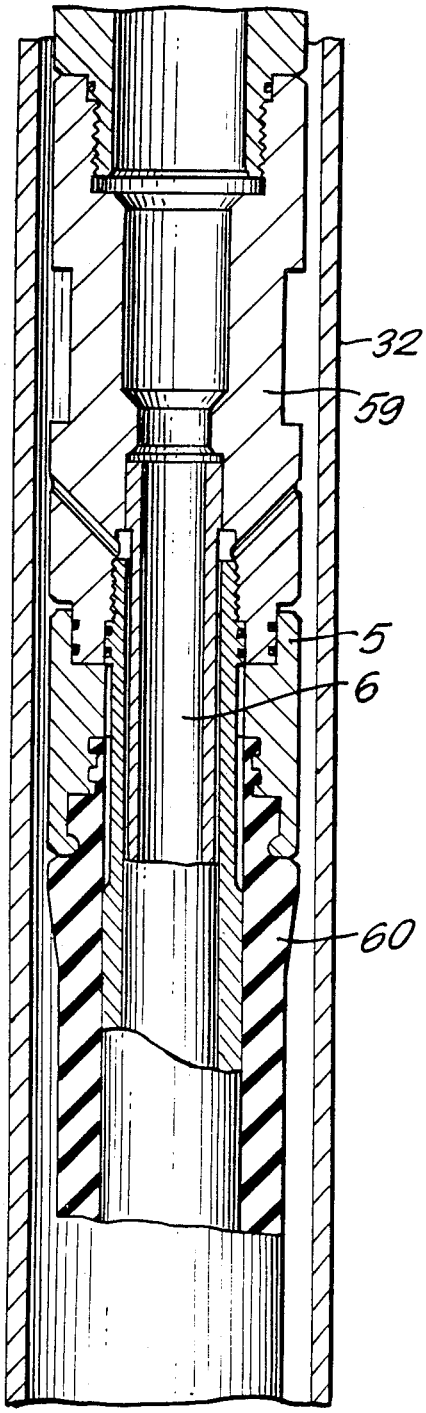
FIGS. 6 and 7 show, in cross section, of the upper packer assembly.
Figure 7:
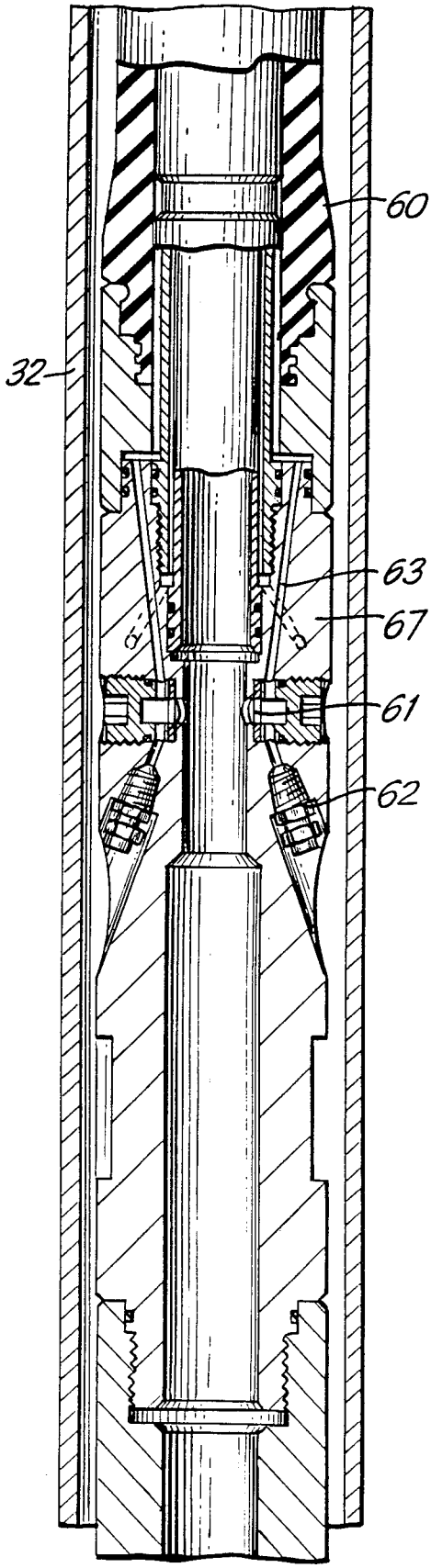

In FIGS. 6 and 7 reference character 60 represents the upper packer, which is fastened at the ends to the steel body of the upper packer assembly, 61 are rupture discs which rupture at pressure P2 to inflate the upper packer (pressure P2 being higher than pressure P1, the pressure at which the lower packer is (inflated), valves 62 are check valves that equalize the head pressure in the well with the pressure on each side of rupture discs 61 to prevent premature bursting of said discs 61, passages 63 lead to the interior face of packer 60 to inflate it. Both packers are shown in the deflated and in the inflated condition on opposite sides of the tool.

The tool is intended to be operable to patch holes in well casing or tubing without removing the liquid contents of the well. This is not only for convenience in the field but also due to the fact that disposal of the well contents could pose an environmental problem.

Figure 3:
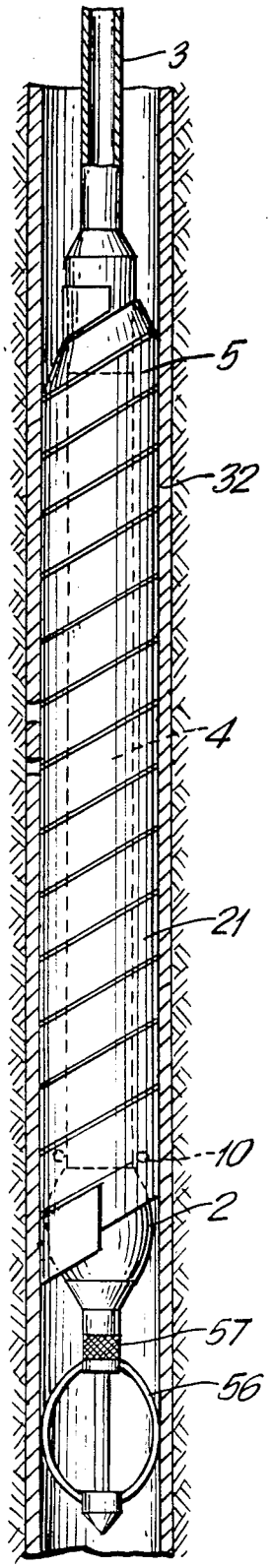
FIG. 3 shows the lower packer assembly in its inflated position with the lining material unwrapped up to the upper packer.

With the tool prepared as described in accordance with FIG. 1 hereinbefore, it is lowered into the well from tubing string 3 to the location of the leaking area in the well which must be patched. It is to be emphasized that the patch can be of considerable length, e.g., 30 feet, 50 feet or even 100 feet or more. As the tool descends, ball-check valve 58 opens to equalize interior pressure in the hollow core of the tool 6 with the pressure in the well. The hydraulic signals transmitted to the tool from the surface depend upon the differential in pressure within the tool, not the absolute pressure. When the tool has reached the area to be patched, as indicated in FIG. 2, pressure in the interior of the tool is increased to P1 and the lower packer is inflated against the casing 32 of the well. This act locks the lower packer assembly against the casing so as to prevent movement and breaks the collar 34, pushing the collar 34 and the first wraps of the lining strip 21 firmly against the inner face of the well casing 32. The tubing string is then rotated from the surface in the direction opposite the wrapping direction of the liner strip to break the shear pin 53. The upper portions of the tool are then rotated to unwrap the liner strip 21 against the inner face of the casing 32 all the way to the upper packer so as to arrive at the position shown in FIG. 3. The resilient nature of the strip material causes it to move against the casing as the strip is unwrapped in a manner akin to the uncoiling of a coiled spring. Internal pressure in the tool is then increased to pressure P2 to rupture the discs 61 and inflate the upper packer. The inflated upper packer 60 breaks the join of the upper collar 34 and presses it firmly against the casing along with the upper wraps of the liner strip 21. Internal pressure is then raised to P3 to open circulating valves 10 and hot water is circulated along the inner face of the liner to set the heat settable resin positioned between the overlapping metal strips 21. When sufficient time at temperature to set the resin has passed, the internal pressure is raised to P4 to blow rupture discs 55. This equalizes the internal and external pressures and deflates the packers, whereupon the tool may be removed from the repaired well. Bypass passages 67 permit the circulating liquid to move past the upper packer without deflating it. Alternatively, longitudinal grooves may be provided in the periphery of the upper packer.

Figure 8:
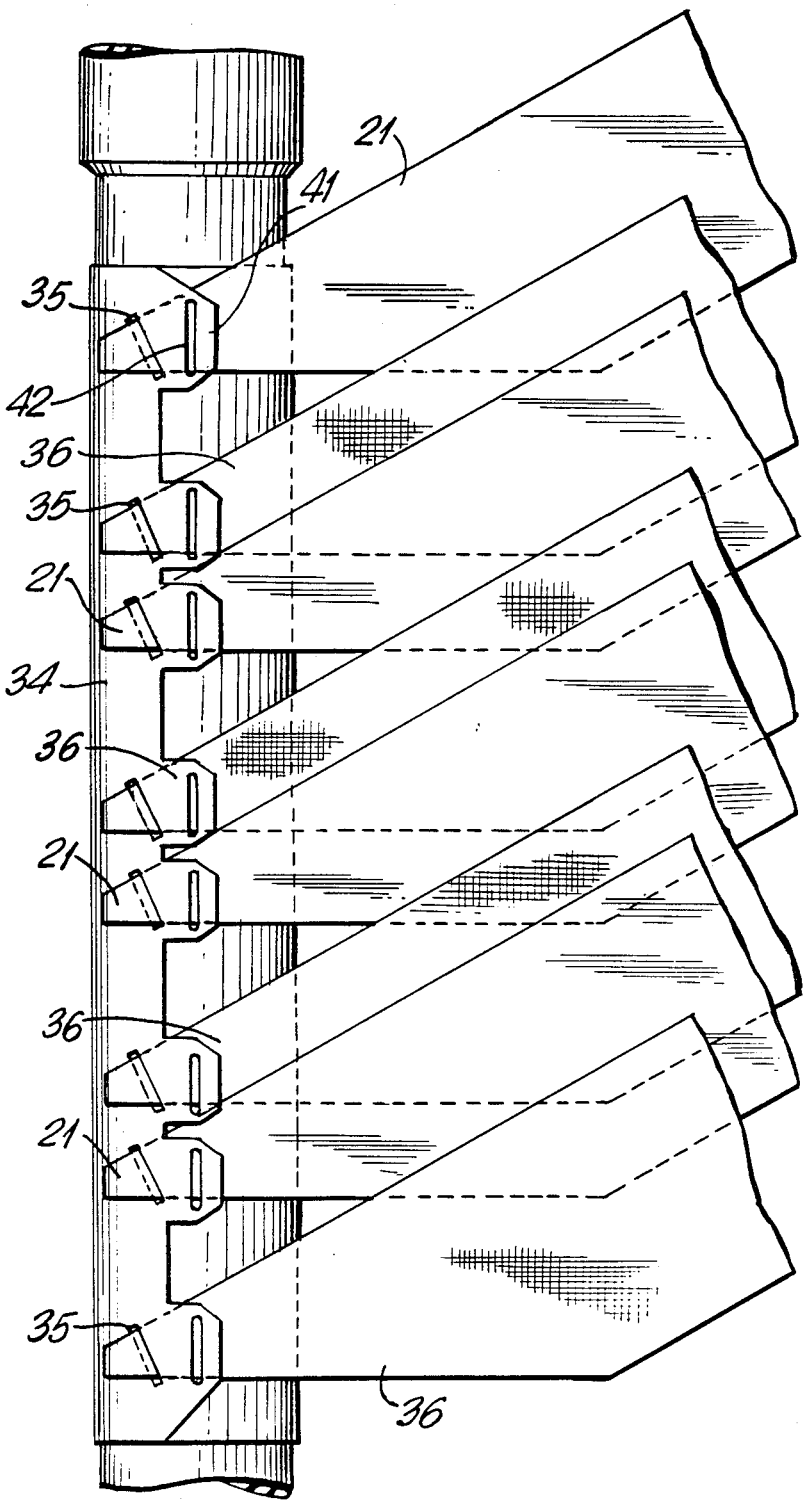
FIG. 8 depicts the arrangement of the wrapping material strip at the initiation of the wrapping operation.

FIG. 8 depicts a preferred pattern for starting the wraps of liner strip about the tool. Collar 34 is provided with a longitudinal set of slots 35 into which the ends of metal strip 21 may be inserted. Between metal strips 21, strips of plastic screen, such as fly screen, impregnated with liquid epoxy are placed (reference character 36) until four strips of each description have been located. Conveniently, the end of each strip is cut at an angle as shown in the drawing. The flap 37, shown more advantageously in FIGS. 9 and 10 overlaps the located ends of the liner strips 21 and 36 to provide a more secure anchor for the strip, and prevent it from becoming unraveled from the tool. The screen material can be fastened to collar 34 using a hot glue gun. It is very important that the strip be securely fastened to the tool and remain so during descent of the tool into the well, becoming detached from the tool only upon commands from the surface.

Figure 9:
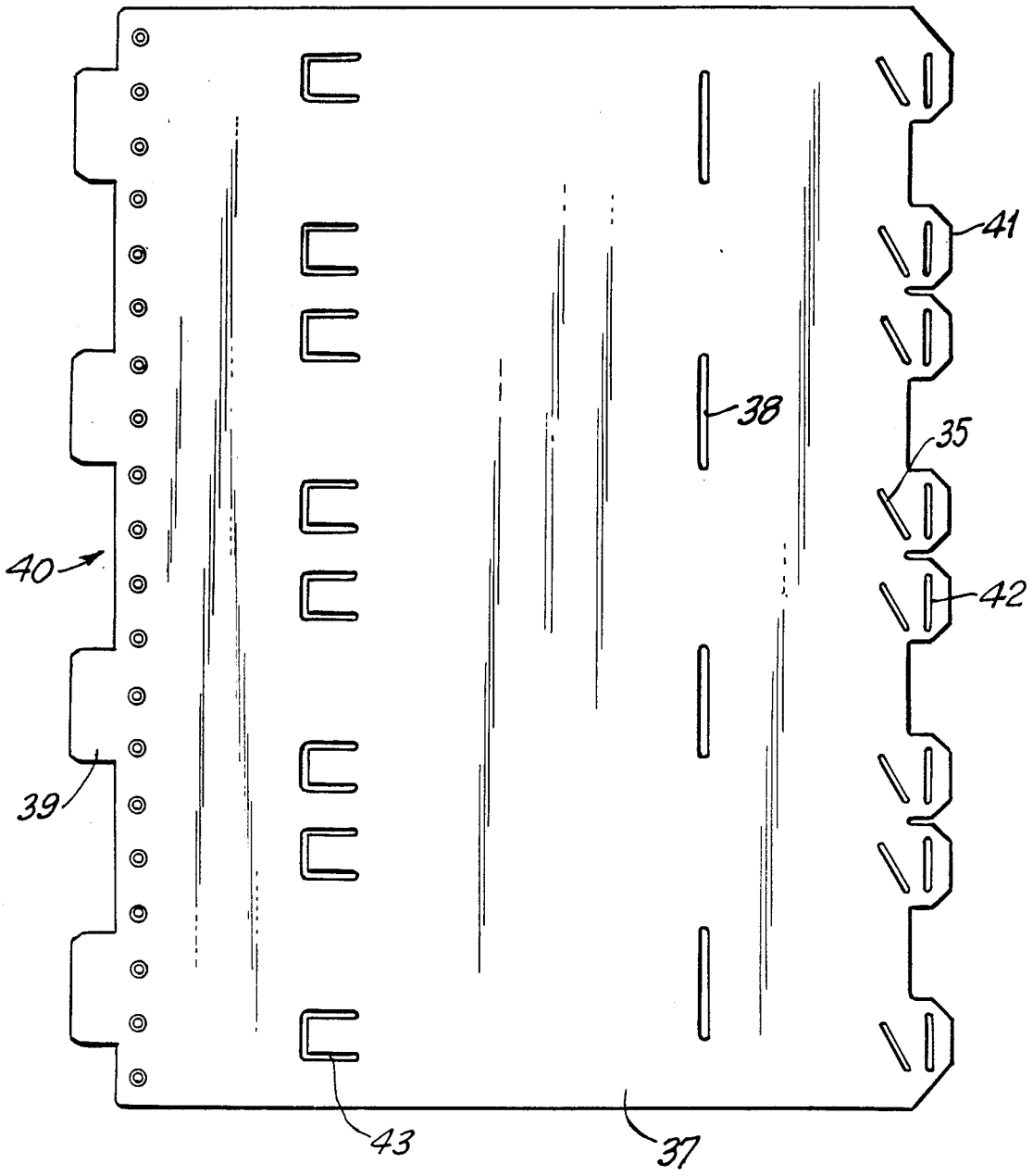
FIG. 9 depicts the thin sheet material which may be formed into a collar about the downhole tool to fasten the wrapping material thereto.

FIG. 9 depicts the pattern of the thin strong sheet material from which the collar is made. The pattern is rectangular and bears an aligned row of slots 38 punched adjacent an edge thereof. A corresponding set of ears 39 parallel to slots 38 is placed at a distance corresponding to the diameter of the collar 34 made when the pattern 40 is rolled into a cylinder. Slots 35, also shown in FIG. 8, are punched adjacent the opposite edge of the pattern 40 to hold the lining strip. It will be seen that a flap 37 is formed when pattern 40 is rolled into a cylinder. Ears 39 may be fastened to pattern 40 in breakaway fashion as by spot welding, or may be dieformed into the pattern. The ear-and-slot system holds together firmly during wrapping of the lining strip and descent of the wrapped tool into the well. The force of the expanded packers exerted internally upon the collar easily ruptures the collar joins when the proper command is given from the surface and the collar material, being springy, presses firmly against the well casing. The collar material can be 0.010 inch thick, aged beryllium copper sheet or strip of high strength.

Figure 11:
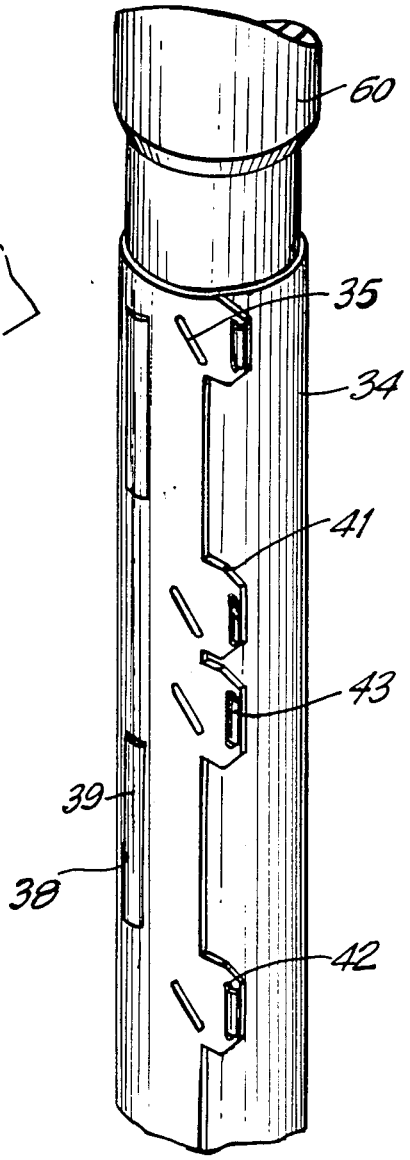

FIG. 10 depicts the pattern 40 of FIG. 8 after it has been rolled into the collar. Slots 38, ears 39, flap 37 and strip-holding slots 35 are shown. Dimples 43 keep collar 34 from slipping on the packer during the wrapping process. A supplemental set of slots 42 and catches 43 cut into pattern 40 may be provided to hold tab 37 tightly to collar 34 as shown in FIG. 11 to facilitate passages of the collar-wrapped packer through machine 11. Catches 43 are released from the lower collar to permit attachment of the liner strip material to tab 37.

Figure 12A:
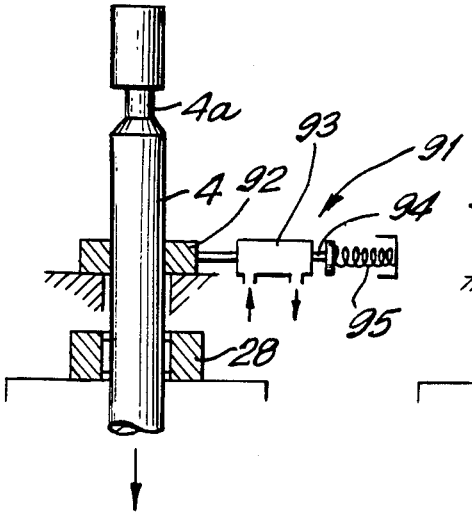
FIGS. 12A through 12E depict a supplemental safety device for preventing undesired loss of the tool down the well.
Figure 12B:
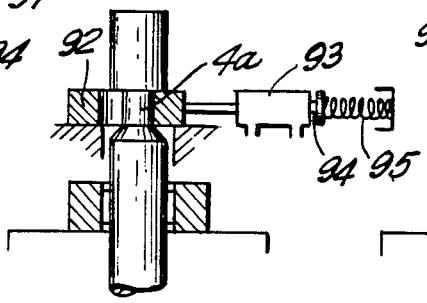
Figure 12C:
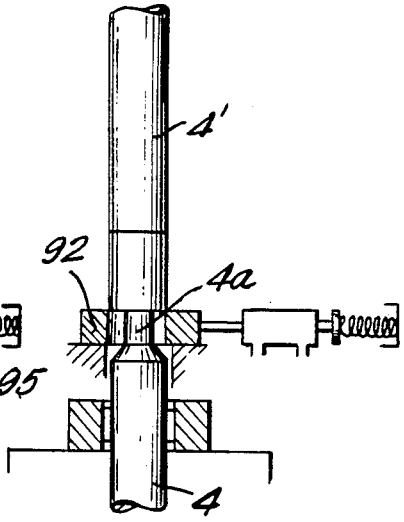
Figure 12D:
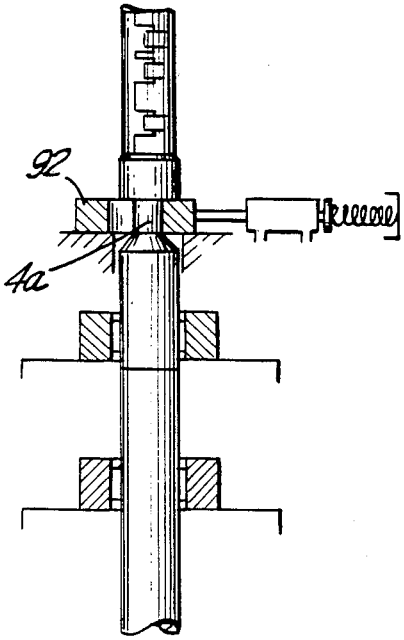
Figure 12E:
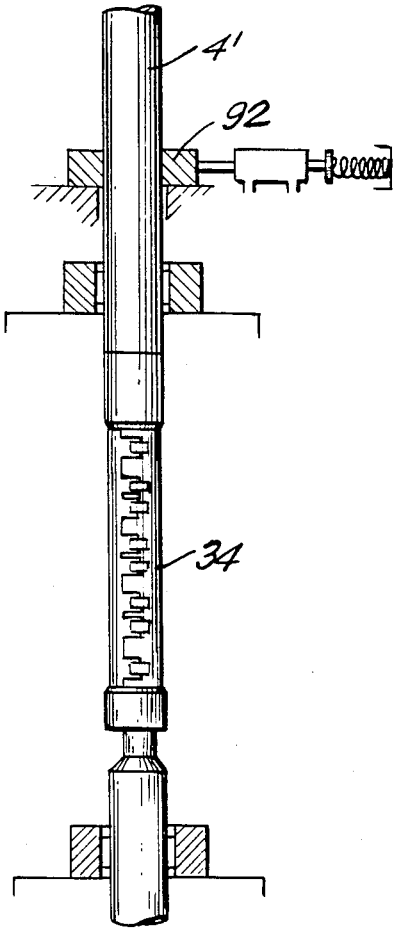

FIGS. 12A through 12E depict an additional safety feature to prevent loss of the tool down the hole during the wrapping process. Each mandrel section can be provided with an annular recess **4*a* near the top end thereof. A shoulder 92 surrounds the tool at a location above upper collet 28. Shoulder 92 is activated by valve 93 and prevents mandrel section from moving down even if upper collet 28 is open, as shown in FIG. 12B. Shoulder 92 is driven by shaft 94 and spring 95**.

It is to be appreciated that the well liner provided in accordance with the invention must pass a "gage" test and a pressure test after it is formed to demonstrate that it presents no impediment to passage of well tools and that it will prevent seepage of undesireable materials from the interior of the well into the environment. This represents a stringent set of criteria which must be passed. Use of 0.010 inch thick strip of beryllium copper alloy; with interspersed epoxy provides in four layers essentially the strength of the original steel casing material and provides far greater corrosion resistance especially to chlorides.

Preferably, the heat settable liquid epoxy is applied to the screen strip material at a point very close to mandrel. A device comprising a tube having a thin slot cut longitudinally therein and having a length of about the width of the screen strip is used as a spreader. Liquid epoxy is stored under pressure in a discardable container and is led to the spreader by a plastic tube provided with a positive displacement meter such as a peristaltic pump, the meter being connected to the screen strip supply such that the meter turns only when screen strip is actually being wrapped. This positive control prevents spillage of liquid epoxy when no wrapping is being conducted. Upon completion of the wrapping operation, only the spreader needs to be cleaned. The container and plastic tube can be discarded, a feature of practical advantage in the field. The device is a joint invention of the present inventor and A.C. Hill and will be covered in a separate application.

What is claimed is:

1. A method for lining bores comprising:

spiral wrapping a plurality of layers of resilient strip form lining material about a hollow mandrel and mechanically securing said material to said mandrel at the ends of said spiral wrapping;

inserting said mandrel and lining material into a bore to be relined;

unwrapping said material from said mandrel so that said material expands until in contact with the bore creating a lining for said bore; and removing said mandrel.

2. The method of claim 1 wherein said material is wrapped about said mandrel with said layers overlapping each other.

3. The method of claim 1 wherein said strip form lining material is metallic material having a yield strength of at least 50,000 psi.

4. (Amended) the method of claim 1 wherein said layers of (metallic) strip material are interleaved with a layer of (strip material) (bearing a heat) settable liquid resin.

5. The method of claim 1 wherein said mandrel comprises upper and lower packer assemblies separated by a length of mandrel material corresponding to the desired relining length, said wrapping of strip material is fastened mechanically at the ends thereof to said packer assemblies, said strip material is unfastened from said lower packer assembly by inflating said assembly against the bore wall, said strip material is unwrapped from said mandrel by rotating said mandrel from a point adjacent said inflated lower packer assembly in a direction opposite to the wrapping direction of said strip material and, when said unwrapping has proceeded to said upper packer assembly, inflating said upper packer assembly to detach the upper mechanical fastening therefrom.

6. The method in accordance with claim 5 wherein said strip material is beryllium copper interleaved with screen material impregnated with a heat settable epoxy resin and said resin is set by means of hot water.

7. The method of claim 1 further comprising the step of including a plurality of layers of material impregnated with a heat settable resin between said layers of strip form lining material and heat setting said resin before removing said mandrel.

8. The method of claim 3 wherein the step of heat setting said resin to bond said lining material together is accomplished by:

circulating hot water from said mandrel along the inner face of said lining in said bore.

9. The method of claim 4 wherein collar means are employed to fasten the ends of said wrapping of strip material to said packer assemblies.

10. A mandrel for repairing a bore comprising:

A lower packer assembly having a diameter less than said bore capable of expanding in size to the diameter of said bore;

a mandrel connected to one end of said lower packer assembly having a diameter of less than the diameter of said bore;

an upper packer assembly having a diameter less than the diameter of said bore, said upper packer assembly being expandable to a diameter equal to the diameter of said bore; (and) means for expanding said lower packer assembly prior to the time when said upper packer assembly is expanded; and a locking assembly between said lower packer assembly and said mandrel such that when unlocked, said locking assembly permits said mandrel and upper packer assembly to rotate independent of said lower packer assembly.

11. The mandrel of claim 10 wherein said upper and lower packer assemblies expand by the application of pressure created by pumping a fluid into said mandrel.

12. The mandrel of claim 11 further comprising a circulating valve located between said upper and lower packer assemblies, which when activated, permits said fluid or gas to pass from said mandrel into said bore.

13. The mandrel of claim 9 wherein said circulating valve is activated only when both of said packer assemblies are inflated.

14. The mandrel of claim further comprising a centralizer.

15. The mandrel of claim 11 wherein the inflation of said upper packer assembly is regulated by one or more rupture discs.

16. The mandrel of claim 11 wherein said mandrel further comprises a pressure release mechanism located below said lower packer assembly which when opened depressurizes said mandrel.

17. The mandrel of claim 16 wherein said pressure release mechanism comprises at least one rupture disc.

* * * * *